United States Patent [19]

Suoss et al.

[11] Patent Number: 4,905,888

[45] Date of Patent: Mar. 6, 1990

[54] PROCESS FOR PROVIDING PACKAGES WITH A HANDLE

[75] Inventors: Bernardus M. Suoss, Monchengladbach; Manfred A. Hintzen, Krefeld; Karl-Andreas Moll, Kaarst, all of Fed. Rep. of Germany

[73] Assignee: Minnesota Mining and Manufacturing Company, St. Paul, Minn.

[21] Appl. No.: 334,193

[22] Filed: Apr. 6, 1989

[30] Foreign Application Priority Data

Apr. 14, 1988 [DE] Fed. Rep. of Germany ..... 3812444

[51] Int. Cl.[4] ..... B65D 5/46

[52] U.S. Cl. ..... 229/117.22; 383/14; 383/21; 383/36; 493/88; 493/909; 229/117.24

[58] Field of Search ..... 229/52 A, 52 AL, 52 BC; 383/14, 21, 26; 493/88, 114, 379, 380, 909

[56] References Cited

U.S. PATENT DOCUMENTS

| | | | |
|---|---|---|---|
| 2,522,049 | 9/1950 | Lang | 229/52 A |
| 2,760,716 | 8/1956 | Weiner | 229/52 A |
| 3,208,492 | 9/1965 | Braithwaite | 383/21 |
| 3,801,012 | 4/1974 | Thelen | 229/52 AL |
| 4,286,714 | 9/1981 | Zdarsky et al. | 229/52 A |
| 4,339,070 | 7/1982 | Davies | 229/52 A |
| 4,498,620 | 2/1985 | Dickert et al. | 229/52 A |
| 4,583,681 | 4/1986 | Neese | 229/52 A |

*Primary Examiner*—Gary Elkins

*Attorney, Agent, or Firm*—Donald M. Sell; Walter N. Kirn; Leland D. Schultz

[57] ABSTRACT

The invention concerns itself with a process for providing a package, especially a parallelepiped form like a carton with a holding device or handle which is attached to the wall of the package so that it can be transported. According to the invention a handle is provided which is integrated into package wall, the shape of the handle being defined by a perforated tear line in the wall. The handle is attached to the wall by means of a carrying tape attached to the inner surface of the wall and the inner surface of the handle, the carrying tape being such that free-moving, strap-type, foldable tape sections are formed between the end section attached to the inner surface of the wall and the middle section of the carrying tape attached to the handle. The strap-type tape sections have a layer which covers their adhesive coating or their adhesive has been neutralized and they form, in conjunction with the handle and when the handle is separated from the package, a freely-moving carrying loop on the package.

27 Claims, 4 Drawing Sheets

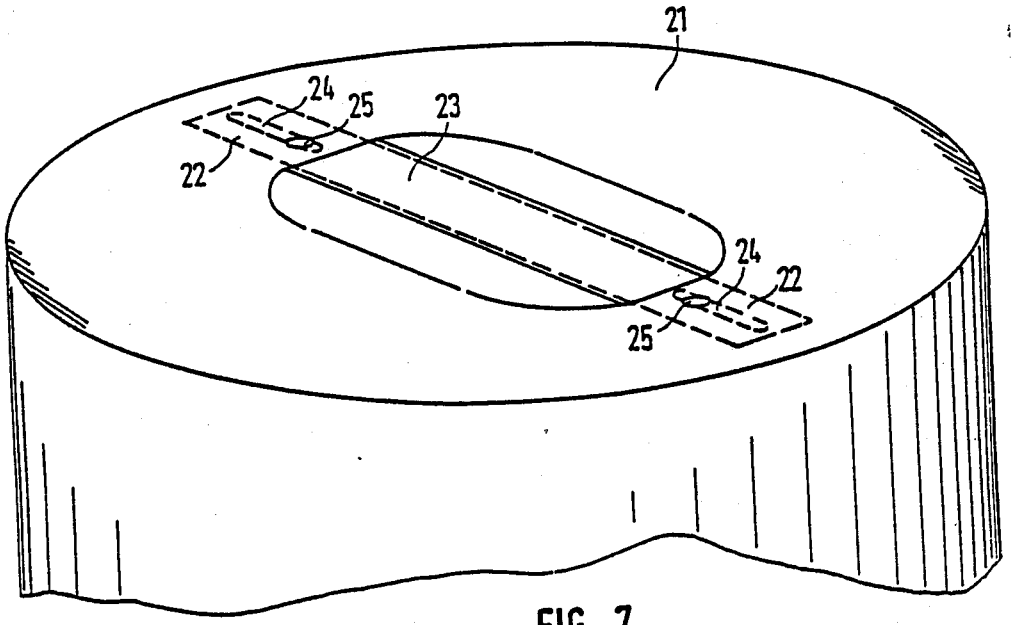
FIG. 7
FIG. 8
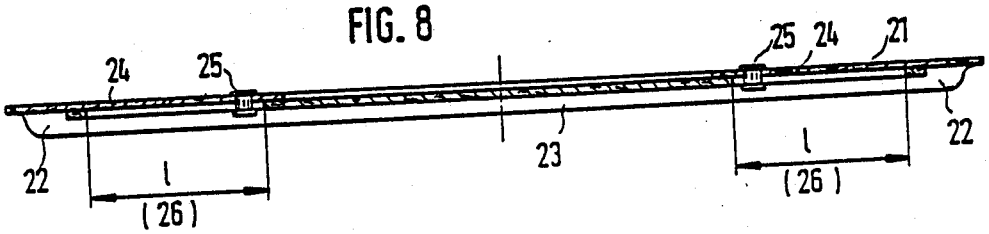

PROCESS FOR PROVIDING PACKAGES WITH A HANDLE

TECHNICAL FIELD

This invention relates generally to packages, and more particularly to packages having handles attached thereto.

BACKGROUND ART

It is important that packages like cartons for soap powder or diapers are provided with a handle so that they can be easily carried by the consumer.

It is known that a carrying tape forming a handle can be fastened to opposite sides of a carton or a pail-shaped container with rivets. The external attachment of this type of handle or carrying tape to each of two opposite sides of the carton or to the cylindrical wall of the pail-shaped container is disadvantageous in that orderly stacking of the cartons or loading them onto palettes can be impaired or prevented by the presence of these carrying tapes or handles and in that the carrying tapes or handles could actually be ripped away at their attachment points.

Known further is a preformed handle unit, consisting of a two-layer carrying element made of cardboard and a plastic band which actually forms the handle, the ends of which bands are adhered between the two layers of the carrying element. In order to attach this separately finished handle-carrying element-unit on the side of a package, like for example on the side of a carton, a rectangular opening must first be stamped out of the wall (top) of the carton and then the handle unit must be fitted in the opening so that the handle extends upward through the opening, whereby the handle is adhered to the inner surface of the wall of the carton. This known process is relatively time-consuming, expensive and requires the use of an excessive amount of material. Additionally, the width of the handle is limited. Experience has shown that with an automatic production system about 50 cartons per minute can be provided with handles of this type.

DISCLOSURE OF INVENTION

The object of the invention is to provide for a process of the kind mentioned above, whereby packages and patterns for packages can be provided with a handle in a way that saves both time and material, this handle being one which is durable and which offers a relatively wide surface which comes in contact with the hand. The package designed according to the current invention or the pattern for packages should at the same time be able to be produced at a considerably improved rate.

The process according to the present invention proves itself to be especially time and material saving in that, for one thing, the handle is formed from the material from the wall of the package or, respectively, the wall section of the pattern and, additionally, the perforation lines and fold lines as well as the carrying tape which forms the holding device can in simultaneous production steps be provided in the wall or wall section or, respectively, be attached to the corresponding inner surface. In this case the tape of the handle is preferably formed from pressure-sensitive adhesive tape. The carrying tape can also preferably be made of a woven material consisting of natural or synthetic fibers. After separation of the perforated lines the handle can simply be grasped and moved vertically upward together with the free-moving strap-type sections for a distance that corresponds to the length of these sections. By folding over both of the side-strips of the handle on the fold lines parallel to the long edges and by means of an overlapping of these two side-strips, the stable carrying surface of the handle is formed. Preferably, the form of the handle can be designed as desired and the width of the handle selected so as to be sufficiently large to provide a comfortable carrying area on the handle, all without significantly reducing the efficiency of the process. The package of the current invention or the pattern for a package of the current invention can be produced or manufactured on an automatic production line at high speed, for example 150 cartons per minute. The handle of the carton according to the present invention can hold considerable weight without ripping. After the package has been carried to its destination, the handle can be unfolded and fitted back into the opening in the side of the carton formed by separation of the perforated lines, whereby the free-moving strap-type sections lie folded together out of the way under the handle. In the case where the carton is intended to hold washing powder (dry detergent) or similar materials, a flexible film can be attached to the inner surface of the wall of the package or the wall section of the pattern, forming a pocket which covers he handle which has been integrated into the package wall or wall section and the attached carrying tape, so that the separation of the handle does not have a negative effect on the powdered contents of the package. The contour or shape of the periphery of the handle which is integrated into the wall or section of a wall of the carton can be defined suitably by perforation lines, whereby enlarged cross-pieces are provided near each of the rounded corners of the rectangular profile. The free-moving strap-type sections of the handle are preferably covered by adhesive tape. The adhesive on these sections can be removed or neutralized by chemical or mechanical means, which could take pale simultaneously with the application of the carrying tape on the inner surface of the handle and the neighboring parts of the wall or parts of the wall sections. Alternatively and preferably one can use a pressure-sensitive adhesive tape, which during its manufacture has been only partially coated with adhesive, so that the free-moving strap-type sections of the carrying tape are adhesive-free from the beginning. The carrying tape can also be reinforced with filament strips. The filaments fibers can also be provided only in the free-moving strap-type sections. At least one additional perforation which defines a finger-grip which can be pushed in can be provided in the handle or in the neighboring parts of the side and bordering on the perforation line. If this perforation is pushed in, then the handle integrated into the side can easily be grasped with the fingers and separated from the side of the carton. If the additional perforation line is located in the handle, then the force required to separate it must be less than the force required to separate the perforation defining the contour of the handle.

The invention is suitable for use in many different types of packages, like for example parallelepiped-forming cartons, but is also suitable for use on barrel-shaped containers which have a flat top surface. The application of the handle described in the present invention has only one prerequisite, that is, that the container has a flat surface. This can be any one of the six boundary surfaces of a parallelepiped-formed package or one of the two flat boundary surfaces of a barrel-formed or cylindrical package. However, the invention is also useful in connection with any other kind of package, which only must have one flat top surface.

The package or patterns for packages of the present invention have the additional advantage that during mechanical or manual stacking of the packages there is absolutely no disturbance by protrusions from the surfaces of the packages.

BRIEF DESCRIPTION OF DRAWINGS

The process and the packages as well as the patterns for the packages described in the present invention will now be described by means of the following drawings. They are:

FIG. 7, a perspective view of the upper surface of a barrel- or pail-shaped container with said mechanically attached carrying tape, and FIG. 8, a cross-sectional view along line 8—8 in FIG. 7.

DETAILED DESCRIPTION

Figure 1:
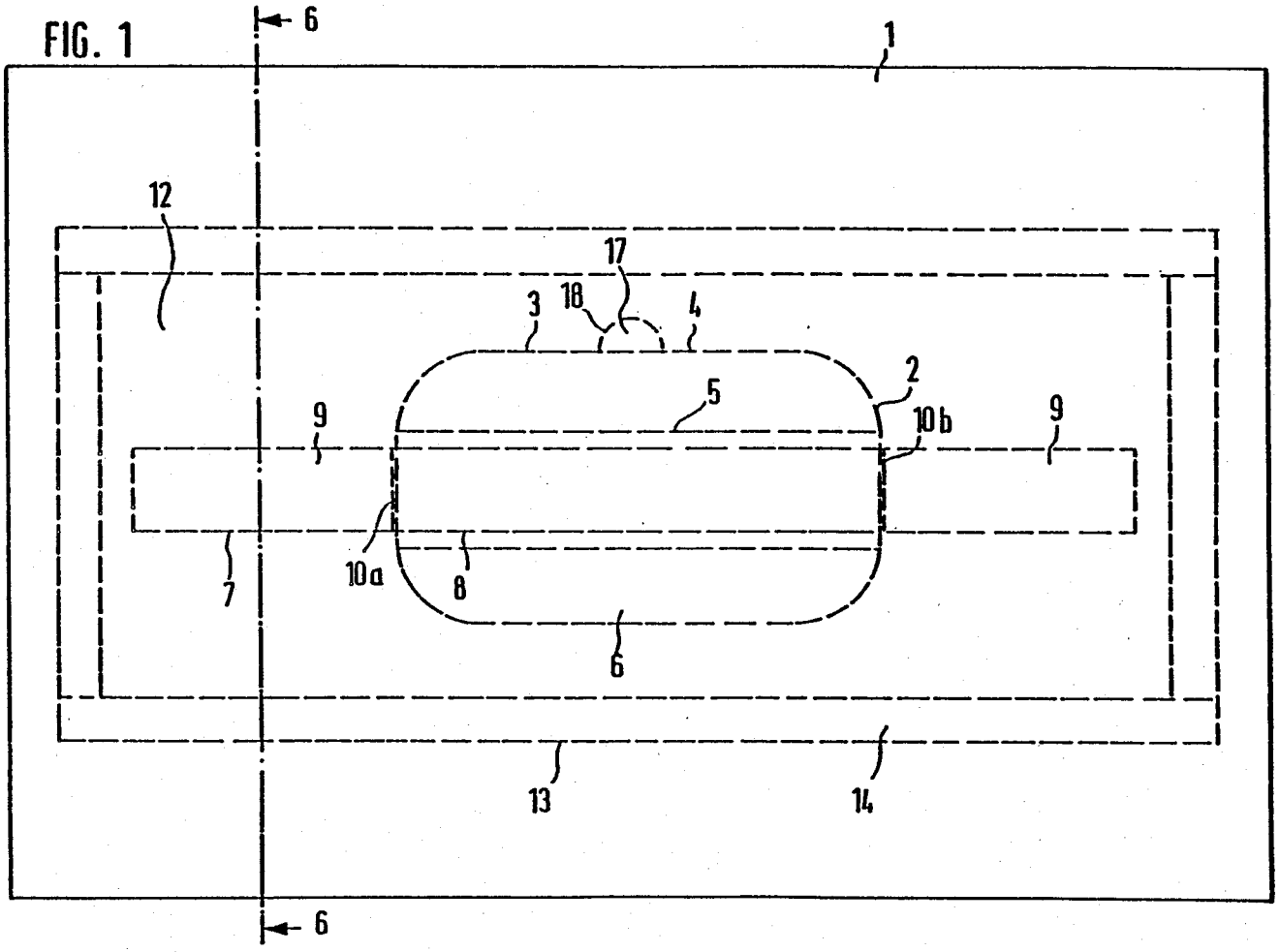
FIG. 1, a top view of the wall section of a pattern in which a handle is integrated and where a flexible film is applied on the inner surface which covers the said handle as well as the carrying tape.

As can be seen in FIG. 1, which shows a top view of a wall section 1 of a package pattern, a perforated tearing line 3 is provided which defines the periphery of a handle element 2 in the wall section 1, this perforation defining a largely rectangular shaped handle element 2 with rounded corners. Parallel to the long sides 4 of the handle 2 which is integrated into the wall section are provided two fold lines 5 in such a way that two longitudinal strips 6 of the handle having essentially the same width are formed, which can be folded along the fold lines 5 to form the handle 2 when the wall section 1 has been separated from the carton. A carrying tape 7 which runs along the length of the handle 2 is represented as a dashed line, said carrying tape being attached in its middle section 8 to the inner surface of the handle 2 integrated into the wall section 1, the area of attachment being centrally located along the longitudinal axis of the handle, and also being attached at the ends to the inner surface of the wall section 1 in the area bordering on the perforation line 3, the attachment being for example by means of adhering, riveting or clamping and also being such that at the same time a free-moving strap-type section 1 is formed between one of the end sections 9 and the corresponding edges 10*a* and 10*b* of the middle section 8, the strap section 11 being invisible in FIG. 1 (see FIGS. 2 through 4) and lying folded together under the handle 2 when the handle 2 is in unused condition. (See broken away part A in FIG. 5). If a pressures-sensitive adhesive tape is used as carrying tape, then the adhesive coating in the area of the free-moving strap-type sections 11 can be neutralized by chemical means or covered by mechanical means.

Furthermore, a flexible film 12 is heat-sealed by means, for example, of a heat-sealing process to the inner surface of the wall section 1 by means of an adhesive zone 14 which stretches all along its periphery 13, whereby a pocket 15 is formed that covers the carrying tape 7. When a package pattern which has this sort of wall section is assembled it forms a closed package for a powdered material, for example, washing powder. In the case of diapers and similar things, the carton may be partially open in which case the pocket 15 is not sealed along the shorter sides of the periphery 13. The film 12 can be omitted from packages which are intended to hold less sensitive articles like, for example, bottles and cans.

As represented further in FIG. 1, preferably at least one additional perforated line 18 bordering on the perforated line 3 which describes an additional finger-grip opening 17 which can be pushed in, can be provided.

Figure 2:
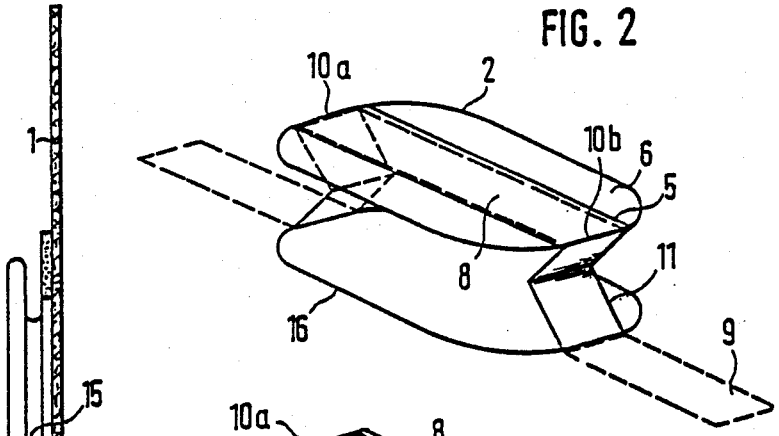
FIGS. 2 through 4, schematic perspective views which show the transformation of the handle separated form the wall section into its use position.
Figure 3:
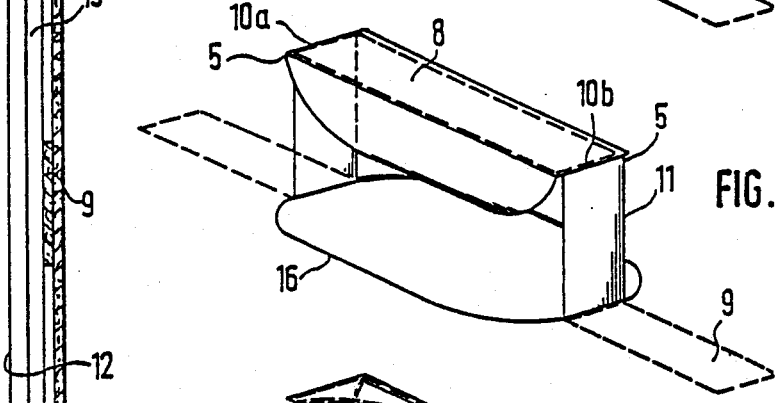
Figure 4:
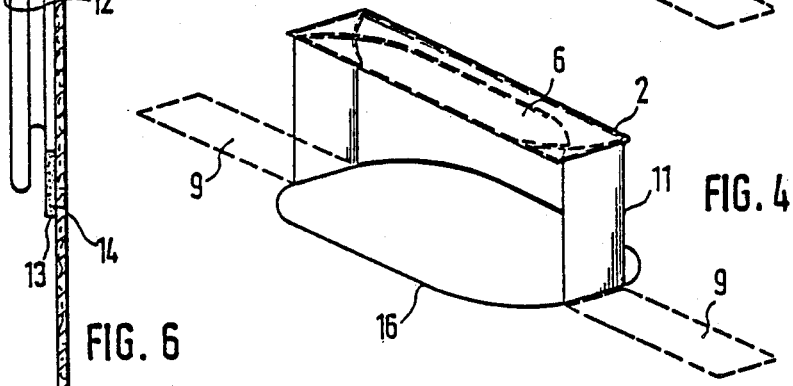
Figure 5:
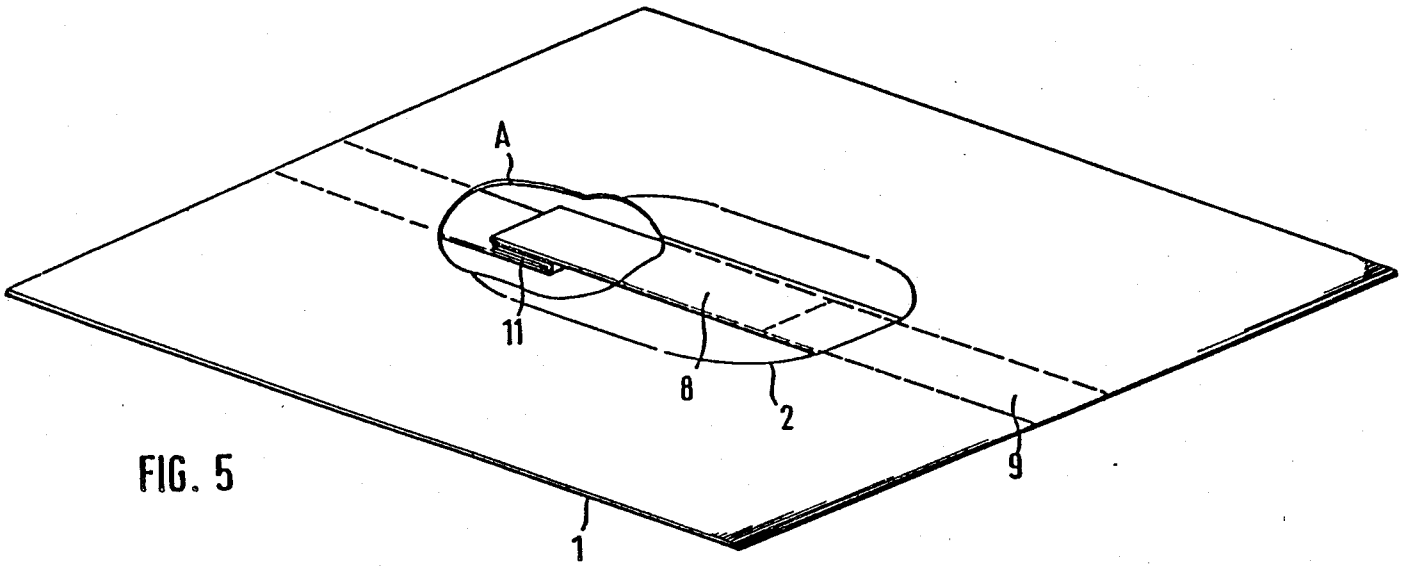
FIG. 5, a perspective view of the wall section, whereby a part of said wall section has been broken off to make the strap-type section visible as it lies in its resting position.

FIGS. 2 through 4 clearly illustrate in three steps the transformation of the handle 2 into the form in which it is to be used to transport the package. As shown in FIG. 2, the handle 2 is set free from its original position as an integrated part of the wall section 1 and moved upwards, whereby the strap-type sections 11 of the carrying tape 7, whose adhesive layer is neutralized, are moved out of their folded position into a half-right position. In FIG. 3 the handle 2 has already been moved to its maximum height above the wall section 1, as indicated by the vertical adhesive-free tape sections 11, and both of the lengthwise strips 6 along both sides of the handle 2 have been folded downward along the fold liens to the extent of 90 degrees. In FIG. 4 the condition has been reached in which the handle is ready to be used, wherein both of the lengthwise strips 6 of the handle 2 have been moved by an additional 90 degrees and lie folded over one another, so that they cover the middle section 8 fastened to the inner surface of the handle 2 and produce a stable carrying are of the handle 2 which is comfortable to carry. In its resting condition, the handle 2 is fitted back into the opening 16 in the wall 1 which was formed by the removal of the handle 2, whereby the free-moving strap-type tape sections 11 are repositioned in their original location, i.e. folded together under the handle 2 (FIG. 5).

Figure 6:
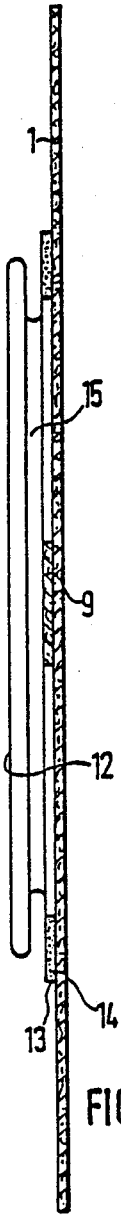
FIG. 6, a view of a lengthwise cut through a wall section on which a flexible film is applied covering the handle and the carrying tape and forming a pocket.

FIG. 6 shows a view of a cross-section made along the line 6—6 as indicated in FIG. 1 and illustrates the pocket 15 whose boundaries are formed by the flexible film 12 and the inner surface of the wall section 1, or respectively, the inner surface of the handle 2 which is still integrated into the section of the wall 1.

A further embodiment of the invention is represented in FIG. 7, in which the handle is provided in the flat wall section or upper surface 21 of a barrel-formed container. Both end sections 22 of the carrying tape 23 are provided with slits 24 which are penetrated by rivets anchored in the upper surface 21.

As shown in FIG. 8, the end section 22 of the carrying tape 23 on the inner side of the flat upper surface 21 are held away from said surface by spacers. A strap-type tape section is defined by the length "l" in the slits 24, this strap-type tale section being freely movable when the carrying tape is pulled out of the opening 27. The opening 27 can be closed when the package is ready for use, so that when the handle is grasped the perforated line 28 breaks and the insert piece is also held in the hand when one lifts the container. In cases where the contents are less sensitive, the carrying tape can be exposed when the package is ready for use, whereby the insert which covers the opening 27 is absent.

We claim:

1. A process for providing packages with a handle which is bound to a wall of the package by means of a fastening device, comprising the steps of:

forming in the wall of the package at least one perforated tear line defining the contours of the handle;

attaching the middle section of a carrying tape, which serves as a mounting device, to the inner surface of the handle integrated into the wall; and attaching each of the end sections to that part of the inner surface of the wall or wall section which borders on the perforated tear line which defines the contours of the handle, thereby forming free-moving strap-type sections between the end sections of the carrying tape attached to the inner surface of the wall or wall section and the associated ends of the middle section attached to the inner surface of the handle, respectively.

2. The process according to claim 1 further comprising the step of defining the contours of the handle in the said wall of the package by several perforated tearing lines which are separated by some distance from one another.

3. The process according to claims 1 and 2, wherein the step of forming the handle which is integrated in the wall further comprises the step of forming a perforated line in the shape of at least a semicircle which can be pushed in to form a finger-grip opening, and which requires a strength for its separation which is less than the strength required for the separation of the perforation which defines the contours of the handle.

4. The process according to claim 1 wherein the tape sections are simultaneously attached on the inner surface of the wall of the package and on the inner surface of the handle which is integrated in to the wall with the formation of at least one perforated tear line.

5. The process according to claim 1 wherein the carrying tape is a pressure-sensitive adhesive tape and the sections of the tape which form the free-moving strap-type sections being designed so that they are adhesive-free.

6. The process according to claim 5 wherein the pressure sensitive adhesive tape has no adhesive coating on the parts which are the free-moving strap-type sections.

7. The process according to claim 5 wherein the adhesive on the free-moving strap-type sections of the pressure-sensitive adhesive tape are neutralized.

8. The process according to claim 1 further comprising the step of attaching the carrying tape by rivets.

9. The process according to claim 1 further comprising the step of forming free-moving strap-type sections of the carrying tape in equal lengths.

10. The process according to claims 1 and 8, wherein the step of applying the tape section to the inner side of the handle includes applying the tape section along the longitudinal of the axis and placing it parallel to and centered between the two long sides, and forming at least one fold line parallel to the long edges of the handle.

11. The process according to claim 10 further comprising the step of forming two fold lines parallel to the long edge of the handle such that after the separation and removal of the handle from the wall of the package or the wall section of the pattern two lengthwise strips are provided which can be folded together over one another as well as over the tape section which is attached to the inner surface of the handle.

12. The process according to claim 1 wherein the step of reinforcing the free-moving strap-type sections of the tape includes the step of reinforcing the strap type sections with filaments.

13. The process according to claim 1 further comprising the step of applying a film to the inner surface of the wall, said film covering the handle which is integrated into the wall and the carrying tape which is attached to the inner surface of the wall and thereby forming a pocket.

14. A package with a handle which is connected to a wall of the package by means of a fastening device, comprising:

(a) at least one perforated tear line in the wall which defines the contours of the handle; and (b) a carrying tape which serves as a mounting device, the middle section of which is attached to the inner surface of the handle which is integrated into the wall, and each of whose end sections are attached to that part of the inner surface of the wall which borders on the perforated tear line which defines the contours of the handle; and (c) the handle being such that at the same time said free-moving strap-type sections are formed between the end section of the carrying tape which is attached to the inner surface of the wall, and the associated end of the middle section is attached to the inner surface of the handle.

15. The package according to claim 14 wherein the contour of the handle in the said wall of the package is defined by several separate perforation lines.

16. The package according to claim 14 further including a semicircular tear line which defines a finger-grip opening which can be pushed in is found in the handle integrated into the wall and the force required to separate the perforation of the finger-grip being less than that force required to separate the perforation defining the contours of the handle.

17. The package according to claim 15 wherein the carrying tape is a pressure-sensitive adhesive tape, the sections of which that form the free-moving straps being themselves free of adhesive.

18. The package according to claim 17 wherein each of the free-moving strap-type sections of the pressure-sensitive adhesive tape is masked by a cover tape.

19. The package according to claim 17 wherein the adhesive on the free-moving strap-type sections of the pressure-sensitive adhesive is neutralized.

20. The package according to claim 15 wherein the free-moving strap-type sections of the carrying tape are of the same length.

21. The package according to claim 15 wherein the middle section of the carrying tape adhered to the inner surface of the handle extends parallel to the longitudinal axis of the handle, and that at least one fold line is provided which runs parallel to the long edge of the handle.

22. The package according to claim 15 further including two fold lines extending parallel to the long edges of the handle which after separation of the handle from the wall of the package produce two lengthwise strips which can be folded over one another as well as over the middle section of the carrying tape attached to the inner surface of the handle.

23. The package according to claim 15 wherein the free-moving strap-type sections are reinforced.

24. The package according to claim 23 wherein the free-moving strap-type sections are reinforced with filaments.

25. The package according to claim 15 wherein an elastic film which covers the handle integrated into the wall and the carrying tape attached to the wall or wall section is applied to the inner surface of the wall of the package thereby forming a pocket.

26. The package according to claim 15 wherein the carrying tape is fastened by rivets.

27. The package according to claim 26 wherein the carrying tape comprises slots, which hold the rivets.

* * * * *